US011799227B2

(12) United States Patent
Pacher et al.

(10) Patent No.: US 11,799,227 B2
(45) Date of Patent: Oct. 24, 2023

(54) CONNECTOR HOUSING AND CONNECTOR ASSEMBLY FOR SEALED RING TERMINAL

(71) Applicant: Aptiv Technologies (2) S.à r.l., Luxembourg (LU)

(72) Inventors: Franz Pacher, Roth (DE); Reinhard Hinteregger, Bad Kleinkirchheim (AT); Prasanna Ramakrishnan, Tamilnadu (IN)

(73) Assignee: Aptiv Technologies (2) S.à r.l., Luxembourg (LU)

( * ) Notice: Subject to any disclaimer, the term of this patent is extended or adjusted under 35 U.S.C. 154(b) by 312 days.

(21) Appl. No.: 17/345,172

(22) Filed: Jun. 11, 2021

(65) Prior Publication Data

US 2021/0391664 A1 Dec. 16, 2021

(30) Foreign Application Priority Data

Jun. 12, 2020 (DE) ..... 10 2020 207 331.7

(51) Int. Cl.
*H01R 13/422* (2006.01)
*H01R 13/52* (2006.01)

(52) U.S. Cl.
CPC ..... *H01R 13/4223* (2013.01); *H01R 13/5202* (2013.01); *H01R 2201/26* (2013.01)

(58) Field of Classification Search
CPC ..... H01R 2201/26; H01R 13/11; H01R 13/5202; H01R 13/422; H01R 13/4223; H01R 13/426; H01R 13/501; H01R 13/521
USPC ..... 439/589, 582, 740, 744
See application file for complete search history.

(56) References Cited

U.S. PATENT DOCUMENTS 3,924,919 A * 12/1975 McClain ..... H01R 13/53 439/588
4,759,725 A * 7/1988 Finch ..... H01R 4/4818 439/535
4,892,491 A * 1/1990 Budano ..... H01R 24/44 439/840
5,219,299 A * 6/1993 Wang ..... H01R 24/42 439/582
5,226,838 A * 7/1993 Hsu ..... H01R 24/547 439/654
5,346,408 A 9/1994 Chupak
(Continued)

FOREIGN PATENT DOCUMENTS

EP 3249756 A1 * 11/2017 ..... H01R 13/5213

*Primary Examiner* — Marcus E Harcum
(74) *Attorney, Agent, or Firm* — Billion & Armitage

(57) ABSTRACT

A connector housing for an electrical connector includes a receiving portion arranged inside a cavity of the connector housing. The receiving portion is adapted to receive an electrical contact terminal. The receiving portion further comprises at least one latching nose adapted to block a release movement of the electrical contact terminal upon insertion of the electrical contact terminal into the connector housing. The connector housing comprises a reinforcement element made of a material different than the material of the connector housing. Said reinforcement element is arranged on a surface of the connector housing and adapted to reinforce at least a part of the connector housing in a region around the at least one latching nose. The present disclosure further relates to a connector assembly for an electrical connector.

18 Claims, 4 Drawing Sheets

(56) References Cited

U.S. PATENT DOCUMENTS 5,387,127 A * 2/1995 Wang ..... H01R 24/547 439/582
5,449,304 A 9/1995 Huss et al.
5,925,854 A 7/1999 Sugiyama
6,428,357 B1 8/2002 Dolinshek et al.
7,179,136 B1 * 2/2007 Morello ..... H01R 13/4223 439/752
7,384,309 B1 * 6/2008 Morello ..... H01R 43/18 29/858
7,438,585 B2 * 10/2008 Morello ..... H01R 13/4364 439/352
7,478,953 B2 * 1/2009 Tanaka ..... G02B 6/4246 398/139
7,658,645 B1 * 2/2010 Morello ..... H01R 13/4223 439/752.5
8,348,707 B2 * 1/2013 Ishikawa ..... H01R 13/055 439/744
9,071,016 B2 * 6/2015 Morello ..... H01R 13/422
9,350,116 B1 * 5/2016 Morello ..... H01R 13/633
9,917,381 B1 * 3/2018 Campbell ..... H01R 9/16
10,079,446 B1 * 9/2018 Sundarakrishnamachari ..... H01R 13/4362
10,312,624 B1 * 6/2019 Baza ..... H01R 13/4361
2004/0192107 A1 * 9/2004 Ikeda ..... H01R 9/05 439/582
2015/0031237 A1 * 1/2015 Chastain ..... H01R 13/15 439/582
2015/0087179 A1 * 3/2015 Yeh ..... H01R 4/5083 439/357
2016/0072212 A1 * 3/2016 Shindo ..... H01R 13/4362 439/744
2018/0026408 A1 * 1/2018 Ensley ..... H01R 24/38 439/578
2018/0131117 A1 * 5/2018 Washio ..... H01R 13/42
2018/0175536 A1 * 6/2018 Rangi ..... H01R 13/424
2018/0366859 A1 * 12/2018 Naoi ..... H01R 13/4223
2019/0379149 A1 * 12/2019 Jin ..... H01R 4/185
2020/0136296 A1 * 4/2020 Tanaka ..... H01R 25/003
2020/0313353 A1 * 10/2020 Kanemura ..... H01R 13/4223
2021/0098925 A1 * 4/2021 Miyakawa ..... H01R 13/428

* cited by examiner

CONNECTOR HOUSING AND CONNECTOR ASSEMBLY FOR SEALED RING TERMINAL

CROSS-REFERENCE TO RELATED APPLICATION

This application claims benefit of priority to German Patent Application No. DE 10-2020-207331.7 filed in the Deutsches Patent-und Markenamt on Jun. 12, 2020, the entire disclosure of which is hereby incorporated by reference.

TECHNICAL FIELD OF THE INVENTION

The present disclosure relates to the field of connector housings, particularly to connector housings for electrical connectors. Further, the invention relates to an electrical connector assembly. A connector housing according to the invention is typically used in vehicles, particularly in the vehicle electrical system.

BACKGROUND

During vehicle operation, different electrical devices, e.g., an ignition and fuel-injection system, control units, safety and comfort and convenience electronics, infotainment systems, lighting, and/or other equipment, have to be supplied with electrical power. For powering the electrical devices, these have to be connected to a power source, such as a vehicle's battery or generator.

A vehicle electrical system, which may be a closed circuit, connects the single electrical devices to the respective power source(s) of the vehicle, and thus powers the respective devices. The devices and the power source(s) of the vehicle electrical system are typically connected via at least one cable harness. At an electrical interface between two components of the vehicle electrical system (i.e., a device, a power source, a cable and/or a cable harness) electrical connectors are typically provided.

Conventional vehicle electrical systems run at 12 volts. However, there is a trend to vehicle electrical systems running at higher voltages, such as 42 volts or 48 volts. These higher voltage vehicle electrical systems can be provided instead of or additionally to the conventional vehicle electrical systems that runs at 12 volts.

Those higher voltage vehicle electrical systems allow to provide more power, compared to conventional 12-volt systems. This is, as e.g., a wire of a given size can carry four times as much power at 48 volts as at 12 volts using the same current (amps).

Thus, higher voltage vehicle electrical systems allow for lighter cable harnesses, as more power can be transmitted using a given wire size. Further, the increasing power demand of the vehicle's electrical devices can be satisfied by establishing higher voltage vehicle electrical systems, as more power can be transferred.

While conventional 12-volt systems may still be used for conventional lighting and infotainment, higher voltage vehicle electrical systems may be used for powering more energy consuming components, such as electrically driven turbochargers, air conditioning, electrical starting assistance systems, and the like. Further, higher voltage vehicle electrical systems allow to provide the electrical energy for electrically powered vehicles, such as electrical or hybrid vehicles, and/or a facilitated recuperation of energy during braking, thereby reducing e.g., fuel consumption and $CO_2$ emissions, etc.

However, with increasing voltage and higher power transmission, the requirements for the electrical interface between two components of the vehicle electrical system increase, i.e., the requirements for connector housings, electrical connectors and connector assemblies, respectively.

These increased requirements lead inter alia to increased dimensions of the connectors and the interface assemblies. For example, to enable more and more power to be transmitted, a diameter of the deployed cables or cable harnesses needs to be increased compared to standard 12-volt electrical systems. The increased diameter entails however further challenges, since for example copper cables with diameters of about 10 mm or more cannot easily be bent around corners. One possible solution known in the prior art is the usage of 90° connectors, in which the cable direction into a connector and the mating direction with a counter connector are perpendicular to each other. To further omit unintended loosening of connector components, e.g., connectors and counter connectors or cables attached to connectors, in particular if used for power transmission, a firm fixation of these respective components and between these respective components and a connector housing is often required. For example, to affix a cable terminal into its respective housing, screws or adhesives can be employed, which require high assembly times and are therefore expensive. Alternatively, a latching of some part of the terminal into the housing can provide a more cost-efficient solution. However, the use of latching systems within connector housings mostly made from plastic involves the risk of breakage or cracks within the deflected plastic part or surrounding areas, which can result in spray water ingress, that is particularly dangerous in higher voltage systems. Thus, there is a need in the art to overcome the aforementioned drawbacks.

SUMMARY

The drawbacks described in the preceding Background section are at least partially overcome by an interface assembly for an electrical power connector and an electrical connector described herein.

Particularly, these drawbacks are at least partially overcome by a connector housing for an electrical connector including a receiving portion arranged inside a cavity of the connector housing. The receiving portion is further configured to receive an electrical contact terminal, in particular an electrical contact ring terminal, and includes at least one, but preferably two latching noses. The latching nose is configured to block a release movement of the electrical contact terminal upon insertion of the electrical contact terminal into the connector housing. Moreover, the connector housing includes a reinforcement element made of a material different than the material of the connector housing. The reinforcement element is arranged on a surface of the connector housing and configured to reinforce at least a part of the connector housing in a region around the at least one latching nose.

In this manner, the present disclosure provides a connector housing, in which an electrical contact terminal can be cost-efficiently and firmly affixed by aid of at least one latching nose. Additional adhesives or securing means can be omitted. Moreover, the reinforcement element according to the present disclosure may provide a reinforcement for at least a portion of the connector housing in the region around the at least one latching nose. By using a different material for the reinforcement element compared to the material of the connector housing, the mechanical properties of both materials can be optimized to complement each other. For example, connector housings or at least parts thereof are often made from plastics, integrally moulded as one piece. A wall thickness of such moulded housings needs to be configured to various parameters, such as to provide enough resistance to e.g., temperature fluctuations, mechanical loads, or others. On the contrary, a slimmed-down construction may be able to reduce the costs by less source material required but may bear the risk of breakage or cracks. In this context, an arrangement of a reinforcement element including higher elasticity, less proneness to crack or similar properties on areas of the connector housing may compensate deficiencies of the connector housing's material alone.

In some embodiments of the present disclosure, the connector housing may be configured to elastically deflect in the region around the at least one latching nose in a direction perpendicular to an insertion direction of the electrical contact terminal into the connector housing. In this manner, the present disclosure may provide a latching system integrally arranged within the connector housing, thus enabling a cost-efficient manufacture of the fixation means of the electrical contact terminal. Alternatively, or additionally, an elastic deflection of the connector housing may further enable to repeatedly assemble or disassemble an electrical contact terminal into a connector housing to allow for a reduced amount of time required for servicing and maintenance of the electrical connector.

In some embodiments of the present disclosure, an average wall thickness of the connector housing in the region around the at least one latching nose may be less than an average wall thickness of the connector housing. An average wall thickness of the connector housing in the region around the at least one latching nose may range between 0.5 mm and 1.0 mm. An average wall thickness of the connector housing outside that region may range between 1.5 mm and 2.5 mm.

The reduced wall thickness of the connector housing may provide an increased elasticity of the connector housing in the region. Therefore, the reduced wall thickness may improve the latching system of the connector housing accordingly. Moreover, the resistance to external parameters of a remainder of the connector housing may be unaltered.

In some embodiments of the present disclosure, the connector housing may include a T-shape having an opening at each of its three ends, the T-shape including a stem portion and a crossbar portion. The one opening of the stem portion, having no opposite opening, may be configured to receive the electrical contact terminal defining the insertion direction. The crossbar portion, having two opposite openings, may provide an essentially cylindrical through hole. In this manner, the present disclosure may provide an improved connector housing for higher voltage electrical systems, in which a cable diameter may prevent a bending of the cable to fit the connector to a counter connector, in particular in the confined space of a car.

In some embodiments of the present disclosure, the receiving portion of the connector housing may be arranged in an overlapping volume of the stem portion and the essentially cylindrical through hole. In this manner, a firm connection of two contacting elements originating from perpendicular directions may be provided.

In some embodiments of the present disclosure, the connector housing may further include a cover. One opening of the essentially cylindrical through hole may be configured to be closed by the cover. The opposite opening of the essentially cylindrical through hole may be configured to be connected to a counter connector or an interface. In this manner, the electrical contact terminal can be arranged in electrical contact with the counter connector or the interface inside the receiving portion of the connector housing, once connector and counter connector are fully mated.

In some embodiments of the present disclosure, both openings of the essentially cylindrical through hole may include a seal, so that the receiving portion of the connector housing is protected against spray water ingress in fully mated condition. Advantageously, a sensitive contact area of the electrical contact terminal and a counter connector or interface can be protected against humidity and dirt coming from outside. The sealing may include a different material than the material of the connector housing.

In some embodiments of the present disclosure, the reinforcement element may be arranged on an outer surface of the connector housing. The reinforcement element may be arranged via overmolding. In this manner, a less complex overmolding process can be used compared to an arrangement on an internal surface of the connector housing. Furthermore, already existing connector designs, including areas prone to cracks, can be improved by an arrangement of an external reinforcement element according to the present disclosure.

The reinforcement element may be at least arranged on a portion of both lateral surfaces of the connector housing. Additionally, or alternatively, the reinforcement element may be at least arranged on a portion of the essentially cylindrical through hole.

The reinforcement element may include silicone. While other materials are also possible, silicone can provide various advantages, in particular in comparison to the material used for the connector housing. An example may be a higher elasticity, lower risk of breakage or cracking, low material costs, high knowledge about this material in the field, low complexity in handling the material etc.

A thickness of the reinforcement element may range between 0.5 mm and 2.0 mm. Additionally, or alternatively, the thickness of the reinforcement element may be configured to fill indentations of the connector housing arising from a reduced wall thickness of the connector housing. This may provide a smooth surface of the connector housing. Accordingly, a risk of tearing or damaging of the reinforcement element may be lowered compared to protruding elements on an external surface.

In some embodiments, the reinforcement element may be configured to reduce the likelihood of a cracking of the connector housing during insertion of the electrical contact terminal compared to the connector housing without the reinforcement element. In particular, if a thickness of the connector housing may be reduced to increase a flexibility of the connector housing in certain areas, the reinforcement element may provide an effective solution to maintain the desired degree of flexibility of the connector housing while reducing the risk of cracks in these areas.

Furthermore, the reinforcement element may be configured to seal a crack in the connector housing caused by the insertion of the electrical contact terminal. Since plasticizer of plastic components are known to evaporate over time, in particular in plastic components exposed to a high degree of heat stress as arising in an electrical system of a car, small cracks may emerge in areas of the connector housing, which are bent or deflected. Thus, even if small cracks emerge within the connector housing according to the present disclosure, the reinforcement element can still protect the interior of the connector housing, in particular sensitive electrical contact areas, from dirt and humidity by sealing and/or covering the crack.

In another aspect, the present disclosure relates to a connector assembly for an electrical connector. The connector assembly includes a connector housing as described above. The connector assembly further includes an electrical contact terminal, wherein a part of an outer surface of the electrical contact terminal is configured to be in contact with an inner surface of the connector housing at the receiving portion upon insertion. The electrical contact terminal includes a recess configured to receive the at least one latching nose of the receiving portion.

BRIEF DESCRIPTION OF THE DRAWINGS

The present invention will now be described, by way of example with reference to the accompanying drawings, in which.

DETAILED DESCRIPTION

Figure 1:
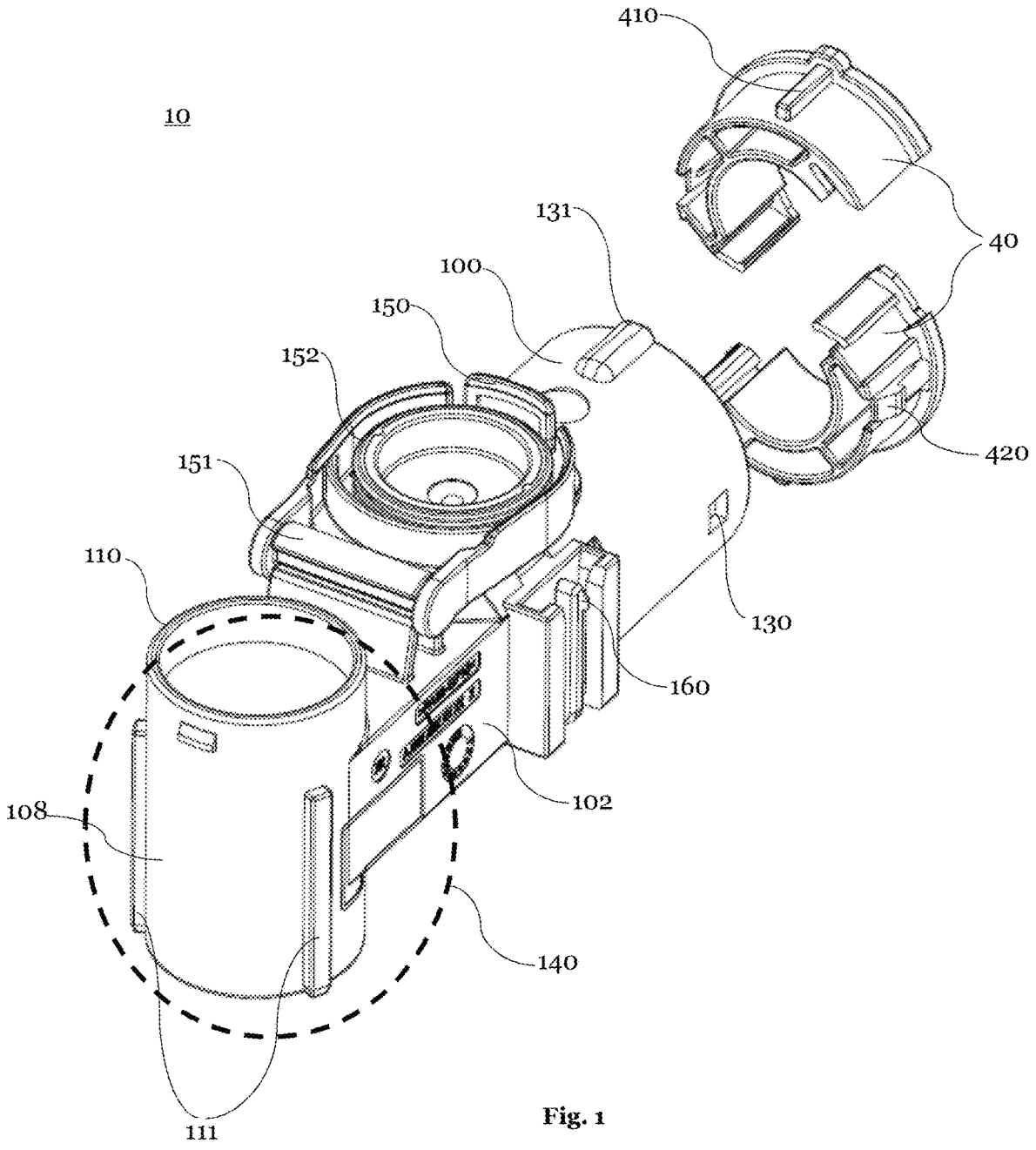
FIG. 1 schematically shows a connector housing, in a three-dimensional view.

FIG. 1 shows an embodiment of a connector housing 10 for an electrical connector. The connector housing 10 may be referred to as a female housing. The connector housing 10 is essentially "T"-shaped including a stem portion 100 and a crossbar portion 108 providing a cavity. The stem portion 100 is configured to receive an electrical contact terminal 30 (cf. FIG. 3*a-b*), wherein a direction of insertion of the electrical contact terminal 30 defines the insertion direction 200 as used in the present disclosure. The crossbar portion 108 defines an essentially circular through hole 110. The term "essentially" is intended to indicate that small deviations from a circular shape, e.g., based on manufacturing deviations or similar factors are also possible.

The connector housing 10 further includes a cover 150 configured to cover one opening of the essentially vertical through hole. The cover 150 includes a hinge 151 to enable a facilitated opening/closing. The cover 150 further includes a sealing 152, preferably made from a soft and elastic material; such as silicone or ELASTOSIL®. The sealing 152 is configured to extend between an inner ring of the cover 150 and the inner surface of the essentially crossbar portion 108 in closed condition. The other opening of the essentially circular through hole 110, opposite to the opening configured to be covered by the cover 150, is further configured to be mated with a corresponding counter connector. Based on the "T"-shape, the mating direction 210 may be aligned essentially perpendicular to the insertion direction 200. To prevent unintended rotations of the connector housing 10 after mating, guiding bars 111 are arranged on the outer surface of the crossbar portion 108, in parallel to the mating direction 210 configured to be inserted in corresponding indentations of the counter connector.

The connector housing 10 further includes a securing hole 130 and guiding slot 131 to enable a fixation of a seal holder 40. The guiding rib 410 of seal holder 40 is guided into the guiding slot 131 of connector housing 10. The securing means 420 of seal holder 40 is secured into securing hole 130 of the connector housing 10. The seal holder 40 is configured to fixate the seal 320 into connector housing 10. The seal holder 40 is further configured to prevent accidental dislocation of seal 320 in the connector housing 10 which leads to sealing failure.

The connector housing 10 further includes a reinforcement element 120 attached to an outer lateral side 102 of the connector housing 10, preferably via overmolding. Details about the reinforcement element 120 are further discussed with respect to FIGS. 3*a*-4 below.

Figure 2:
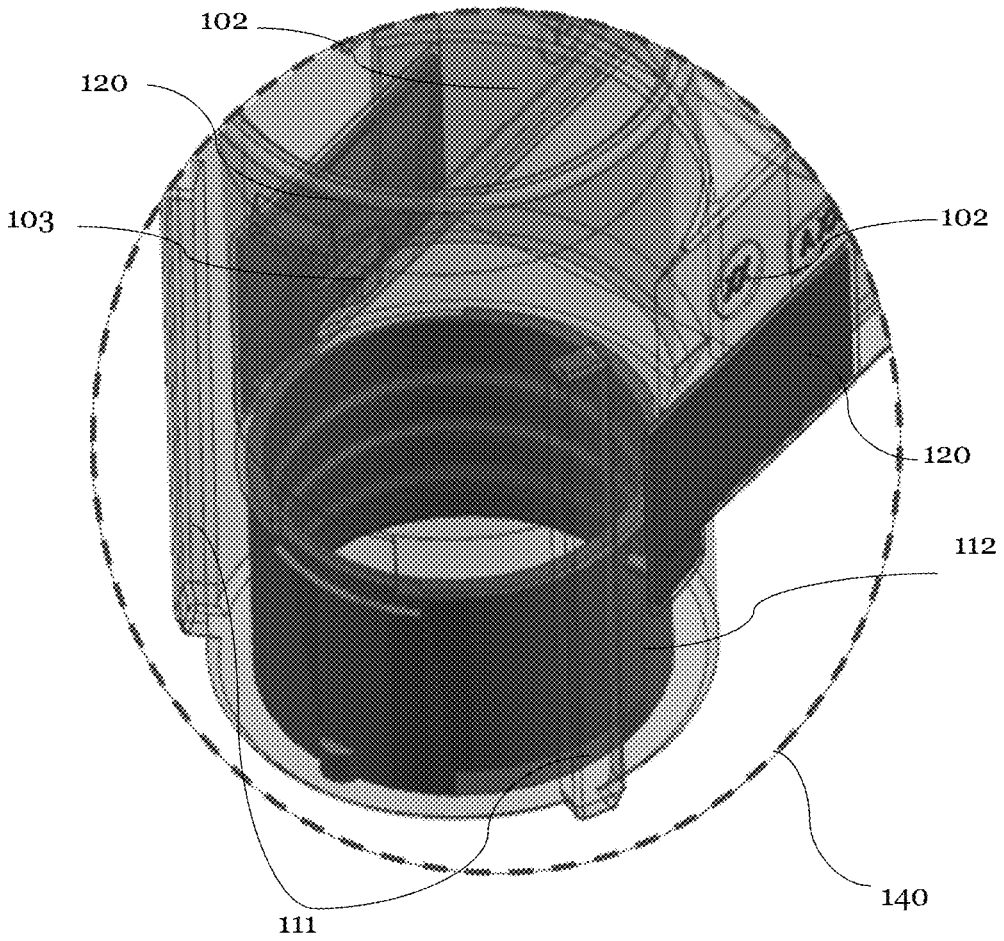
FIG. 2 schematically shows an enlarged section of the connector housing of FIG. 1 in a partly translucent view.

FIG. 2 shows an enlarged section 140 of the essentially circular through hole 110 in a partly translucent illustration. A sealing 112 is arranged on the opening configured to be mated with a counter connector or an interface. In this manner, an overlapping volume of the stem portion 100 and crossbar portion 108 of the connector housing 10 can be fully protected from spray water ingress or dirt in fully mated condition. This protected overlapping volume includes a receiving portion, in which the electrical contact between the electrical contact terminal 30 and the corresponding contact of the counter connector or an interface is intended to be arranged. The sealing 112 includes circular protrusions, which after latching into corresponding indentations of the counter connector or an interface provide the described sealing property. The receiving portion further includes two latching noses 103, configured to block a release movement of the electrical contact terminal 30 after insertion.

Figure 3A:
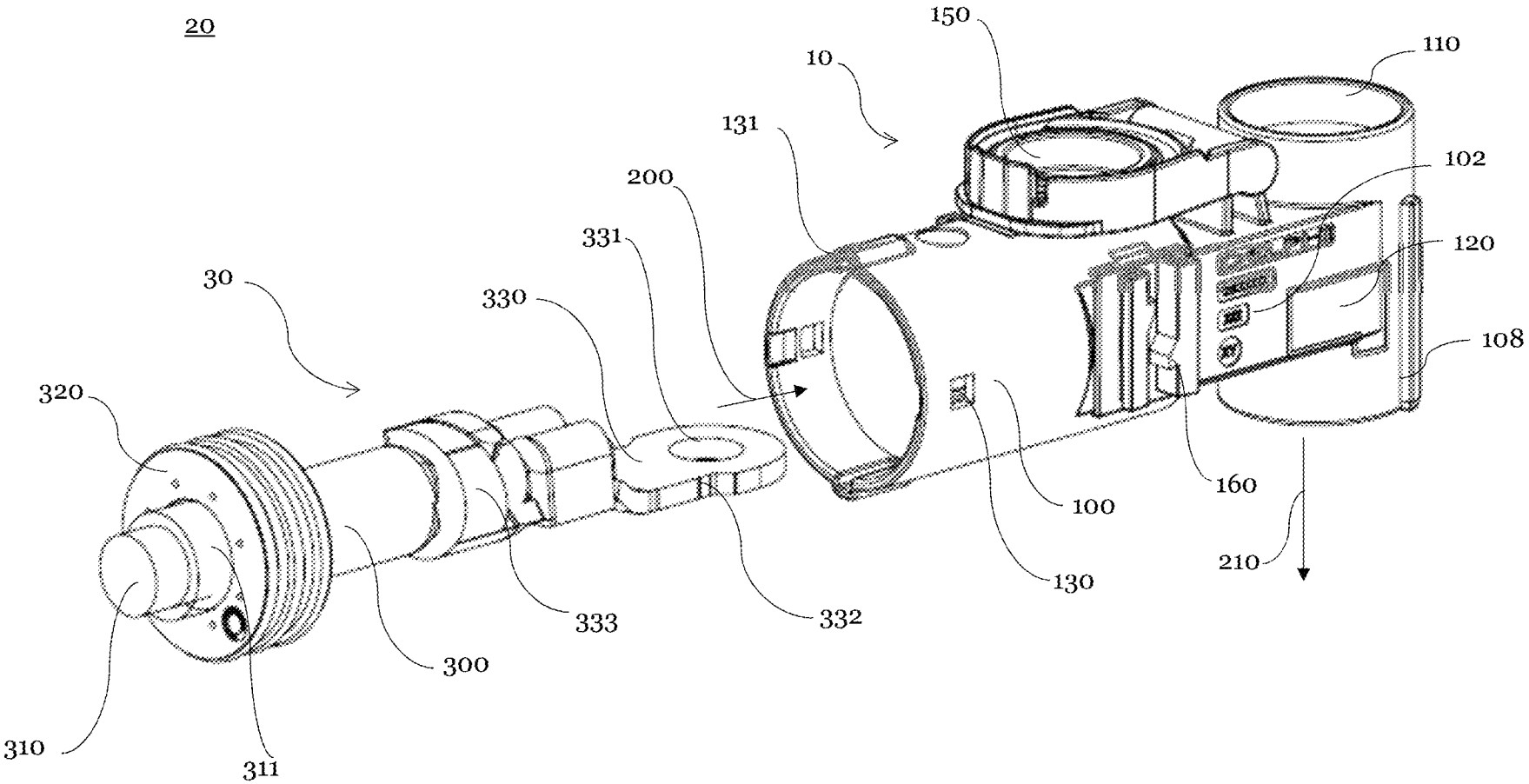
FIG. 3*a* schematically shows a connector assembly in a disassembled condition.
Figure 3B:
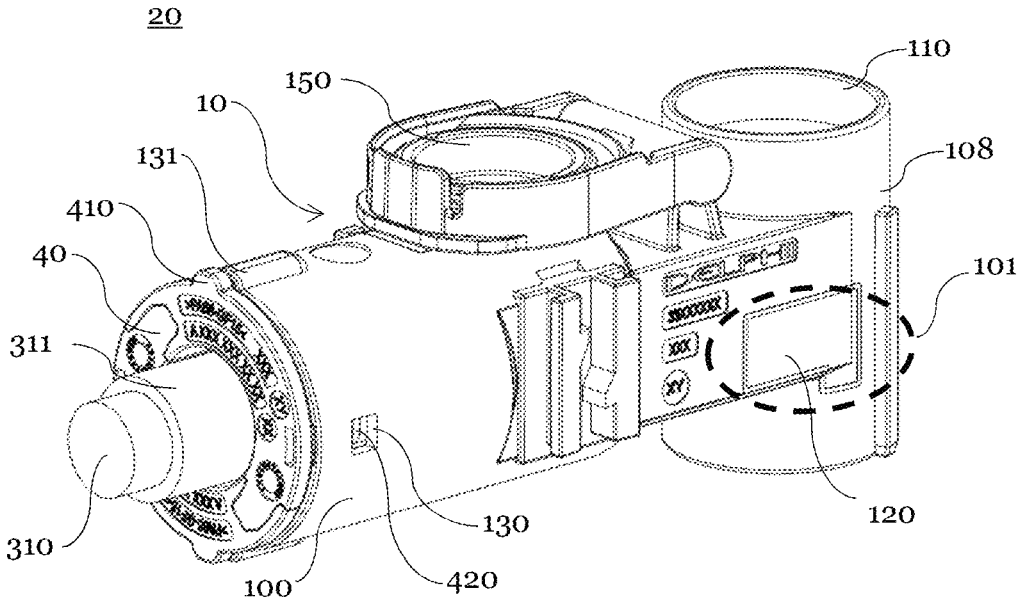
FIG. 3*b* schematically shows the connector assembly of FIG. 3*a* including a seal holder in an assembled condition.

FIG. 3*a* shows an embodiment of a connector assembly 20 in a disassembled condition and FIG. 3*b* shows the connector assembly 20 in a completely assembled condition. The connector assembly 20 includes a connector housing 10, similar as described above with reference to FIGS. 1 and 2 and an electrical contact terminal 30. The electrical contact terminal 30 includes a ring terminal portion 330 attached to a cable 300 via a crimp connection 333. The cable 300 includes a core 310 for transmitting electrical power and a shielding 311. A cross section of the core 310 may range between 16 $mm^2$ and 85 $mm^2$. The ring terminal portion 330 further includes a through hole 331, configured to be pierced through by a pin or cable of a corresponding counter connector or an interface to provide electrical contact between both components. In this context, the electrical contact terminal 30 can be inserted into the connector housing 10. By pressing the electrical contact terminal 30 into the connector housing 10 the ring terminal portion 330 may slip into the receiving portion of the connector housing 10. The slipping may cause the latching noses 103 of the connector housing 10 to elastically deflect in a direction perpendicular to the insertion direction 200. Accordingly, the front part of the ring terminal portion 330 can be pushed past the latching noses 103, which thereupon latch into the recess 332 of the ring terminal portion 330. As a result, the ring terminal portion 330 may be firmly arranged inside the receiving portion of the connector housing 10. To enable a facilitated and improved insertion of the electrical contact terminal 30, a wall thickness 104 of the connector housing 10 may be reduced in the region around the latching noses 101 in comparison to a remainder or an average wall thickness of the connector housing 10. This results in an increased elasticity of the connector housing 10 in the region around the latching noses 101. In order to reduce the likelihood of cracks in the region around the latching noses 101, a reinforcement element 120 can be attached, in particular overmolded.

The reinforcement element 120 may be made from silicone, which provides a higher tear resistance while being more flexible compared to the plastic material used for the connector housing. A thickness of the reinforcement element 120 may range between 0.5 mm and 1.5 mm. Additionally, or alternatively, the thickness of the reinforcement element 120 can be configured to fill indentations of the connector housing 10. The indentations may be based on the reduced wall thickness 104 of the connector housing 10. In this manner, the present embodiment provides an effective solution to maintain the flexibility of the connector housing 10 essentially unaltered but decreases the chance of cracks by introducing a reinforcement element 120 in the regions around the latching noses 101. The reinforcement element 120 can be arranged on a lateral side 102 of the stem portion 100 and at least a portion of the essentially circular through hole 110, to reinforce the areas of the connector housing 10 most prone to cracks. In addition, if for a small percentage of up to 5% to 10% of the connector assemblies 20 including the reinforcement element 120 a small crack still emerges during insertion of the electrical contact terminal 30, the reinforcement element 120 may be able to maintain a protection of sensitive electrical contact areas from spray water ingress or dirt within the receiving portion by providing a sealing of the crack. In this manner, the reinforcement element 120 may directly cover the small crack during its occurrence.

Figure 4:
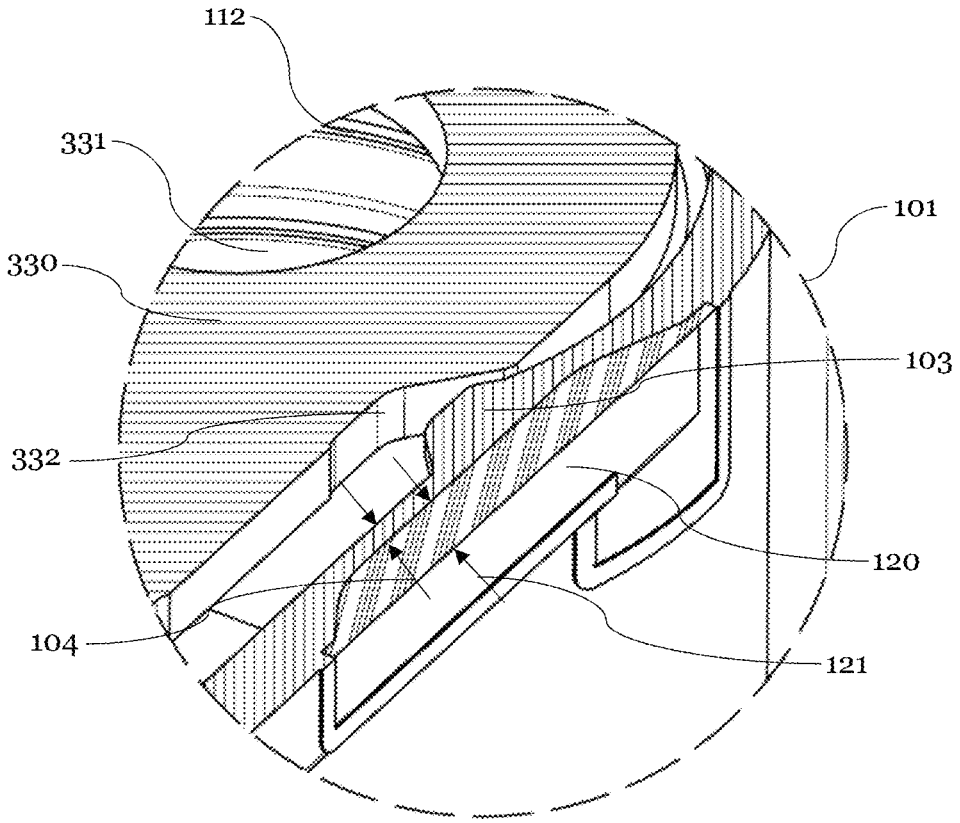
FIG. 4 schematically shows a horizontal section of a plane through a region around the latching noses of the connector assembly of FIG. 3*b*.

FIG. 4 shows an enlarged section of an embodiment of a region around the latching noses 101, in which an arrangement of the various components of an electrical contact terminal 30 and a connector housing 10 are presented in more detail. Moreover, a latching process as described with reference to FIGS. 3*a* and 3*b* can be understood in more detail, by aid of the enlarged section.

LISTING OF REFERENCE NUMBERS

10 connector housing
20 connector assembly
30 electrical contact terminal
100 stem portion
101 region around latching noses
102 lateral side
103 latching nose
104 wall thickness
108 crossbar portion
110 essentially circular through hole
111 guiding bar
112 sealing
120 reinforcement element
121 thickness of reinforcement element
130 securing hole
131 guiding slot
140 enlarged section
150 cover
151 hinge
152 sealing
160 fixation means
200 insertion direction
210 mating direction
300 cable
310 cable core
311 cable shielding
320 seal
330 ring terminal portion
331 through hole
332 recess
333 crimp connection
40 seal holder
410 guiding rib
420 securing means

The invention claimed is:

1. A connector housing, comprising:

a receiving portion arranged inside a cavity of the connector housing, configured to receive an electrical contact terminal, wherein the receiving portion comprises at least one latching nose configured to block a release movement of the electrical contact terminal upon insertion of the electrical contact terminal into the connector housing, wherein the connector housing comprises a reinforcement element made of a material different than the material of the connector housing, wherein the reinforcement element is arranged on a surface of the connector housing and configured to reinforce at least a part of the connector housing in a region around the at least one latching nose, wherein the connector housing comprises a T-shape having an opening at each of its three ends, the T-shape comprising a stem portion and a crossbar portion, wherein the one opening of the stem portion, having no opposite opening, is configured to receive the electrical contact terminal defining an insertion direction, wherein the crossbar portion, having two opposite openings, provides an essentially cylindrical through hole, and wherein the receiving portion of the connector housing is arranged in an overlapping volume of the stem portion and the essentially cylindrical through hole; and a cover, wherein one opening of the essentially cylindrical through hole is configured to be closed by the cover.

2. The connector housing according to claim 1, wherein the connector housing is configured to elastically deflect in the region around the at least one latching nose in a direction perpendicular to an insertion direction of the electrical contact terminal into the connector housing.

3. The connector housing according to claim 1, wherein an average wall thickness of the connector housing in the region around the at least one latching nose is less than an average wall thickness of the connector housing.

4. The connector housing according to claim 1, wherein an average wall thickness of the connector housing in the region around the at least one latching nose ranges between 0.5 mm and 1.0 mm and wherein an average wall thickness of the connector housing ranges between 1.5 mm and 2.5 mm.

5. The connector housing according to claim 1, wherein the opposite opening of the essentially cylindrical through hole is configured to be connected to a counter connector, so that the electrical contact terminal is arranged in electrical contact with the counter connector inside the receiving portion of the connector housing in a fully mated condition.

6. The connector housing according to claim 5, wherein both openings of the essentially cylindrical through hole comprise a seal, so that the receiving portion of the connector housing is protected against spray water ingress in fully mated condition.

7. The connector housing according to claim 1, wherein the opposite opening of the essentially cylindrical through hole is configured to be connected to an interface, so that the electrical contact terminal is arranged in electrical contact with the interface inside the receiving portion of the connector housing in a fully mated condition.

8. The connector housing according to claim 7, wherein both openings of the essentially cylindrical through hole comprise a seal, so that the receiving portion of the connector housing is protected against spray water ingress in fully mated condition.

9. The connector housing according to claim 8, wherein the reinforcement element is arranged on an outer surface of the connector housing, optionally via overmolding.

10. The connector housing according to claim 9, wherein the reinforcement element is at least arranged on a portion of both lateral surfaces of the connector housing and/or a portion of the essentially cylindrical through hole.

11. The connector housing according to claim 1, wherein the reinforcement element comprises silicone.

12. The connector housing according to claim 1, wherein a thickness of the reinforcement element ranges between 0.5 mm and 2.0.

13. The connector housing according to claim 1, wherein a thickness of the reinforcement element is configured to fill indentations of the connector housing arising from a reduced wall thickness of the connector housing to provide a smooth surface of the connector housing.

14. A connector housing, comprising:

a receiving portion arranged inside a cavity of the connector housing, configured to receive an electrical contact terminal, wherein the receiving portion comprises at least one latching nose configured to block a release movement of the electrical contact terminal upon insertion of the electrical contact terminal into the connector housing and wherein the connector housing comprises a reinforcement element made of a material different than the material of the connector housing, wherein the reinforcement element is arranged on a surface of the connector housing and configured to reinforce at least a part of the connector housing in a region around the at least one latching nose, wherein the reinforcement element is configured to reduce a likelihood of a cracking of the connector housing during insertion of the electrical contact terminal compared to a connector housing without the reinforcement element.

15. A connector housing, comprising:

a receiving portion arranged inside a cavity of the connector housing, configured to receive an electrical contact terminal, wherein the receiving portion comprises at least one latching nose configured to block a release movement of the electrical contact terminal upon insertion of the electrical contact terminal into the connector housing and wherein the connector housing comprises a reinforcement element made of a material different than the material of the connector housing, wherein the reinforcement element is arranged on a surface of the connector housing and configured to reinforce at least a part of the connector housing in a region around the at least one latching nose, wherein the reinforcement element is configured to seal a crack in the connector housing caused by the insertion of the electrical contact terminal.

16. An electrical connector assembly, comprising:

the connector housing according to claim 1; and the electrical contact terminal, wherein a part of an outer surface of the electrical contact terminal is configured to be in contact with an inner surface of the connector housing at the receiving portion upon insertion, and wherein the electrical contact terminal comprises a recess configured to receive the at least one latching nose of the receiving portion.

17. An electrical connector assembly, comprising:

the connector housing according to claim 14; and the electrical contact terminal, wherein a part of an outer surface of the electrical contact terminal is configured to be in contact with an inner surface of the connector housing at the receiving portion upon insertion, and wherein the electrical contact terminal comprises a recess configured to receive the at least one latching nose of the receiving portion.

18. An electrical connector assembly, comprising:

the connector housing according to claim 15; and the electrical contact terminal, wherein a part of an outer surface of the electrical contact terminal is configured to be in contact with an inner surface of the connector housing at the receiving portion upon insertion, and wherein the electrical contact terminal comprises a recess configured to receive the at least one latching nose of the receiving portion.

* * * * *